US007588037B1

(12) United States Patent
Ratliff et al.

(10) Patent No.: US 7,588,037 B1
(45) Date of Patent: Sep. 15, 2009

(54) APPARATUS AND METHOD FOR CLEANING AND DECONTAMINATING AN AIR DISTRIBUTION SYSTEM

(76) Inventors: Thomas R. Ratliff, 115 Ironwood Dr., Republic, MO (US) 65738; Darrel Lathrop, 115 Ironwood Dr., Republic, MO (US) 65738

( * ) Notice: Subject to any disclaimer, the term of this patent is extended or adjusted under 35 U.S.C. 154(b) by 712 days.

(21) Appl. No.: 10/965,396

(22) Filed: Oct. 15, 2004

(51) Int. Cl.
*B08B 9/02* (2006.01)

(52) U.S. Cl. ..... 134/22.1

(58) Field of Classification Search ..... 134/22.1
See application file for complete search history.

(56) References Cited

U.S. PATENT DOCUMENTS 4,259,945 A * 4/1981 Lawson ..... 126/299 E
5,042,457 A * 8/1991 Gallagher ..... 126/299 E
5,072,487 A * 12/1991 Walton ..... 15/406
5,298,043 A * 3/1994 Mai et al. ..... 96/240
6,478,033 B1 * 11/2002 Foster ..... 134/22.18
2003/0041407 A1 * 3/2003 Savage ..... 15/321
2003/0217421 A1 * 11/2003 Besel ..... 15/50.1

* cited by examiner

*Primary Examiner*—Michael Cleveland
*Assistant Examiner*—Samuel A Waldbaum
(74) *Attorney, Agent, or Firm*—Donald R. Schoonover

(57) ABSTRACT

An apparatus for cleaning and decontaminating an air distribution system includes a sources separately containing a first fluid and a second fluid, a pressurizing system for separately pressurizing the first and second fluids, a distribution subsystem for separately conveying the first and second fluids to a plurality of injectors that convert the first and second fluids into a foam-like substance before injecting the foam-like substance into the air distribution system. The apparatus includes a control system for controlling the pressure and flow rate of the first and second fluids, and a system for removing the foam-like substance from the air distribution system after the foam-like substance has cleaned and decontaminated the air distribution system. A method for cleaning and decontaminating an air distribution system is also disclosed.

22 Claims, 4 Drawing Sheets

APPARATUS AND METHOD FOR CLEANING AND DECONTAMINATING AN AIR DISTRIBUTION SYSTEM

BACKGROUND OF THE INVENTION

1. Field of the Invention

The present invention is related to cleaning equipment and, more specifically without limitation, to cleaning and decontaminating equipment for heating, ventilating and air-conditioning (HVAC) systems.

2. Discussion of the Related Art

More and more people are becoming aware that allergies and various respiratory ailments are exacerbated by various air-entrained particulate substances. It is being increasingly recognized that a common source for such particulate substances is settlement, decaying insects, mold, and other debris and pollutants that accumulate over time in air distribution systems, such as ductwork and the like. Various equipment, somewhat like air vacuuming cleaners, have been developed with long flexible hoses that can be extended into ductwork in an attempt to suction such debris from ductwork.

Thorough cleaning and sanitization of an air distribution system on a timely basis would help to prevent and largely eliminate air borne mold and other particulate matter from being recirculated in a building interior from the air distribution system. Loose debris that is spaced in relatively close proximity to the suctioning end of such air vacuuming cleaners may be effectively removed as the hose is extended along the ductwork. However, loose debris that is not spaced in relatively close proximity to the suctioning end of such air vacuuming cleaners may remain in the ductwork to continue contaminating air that flows through the ductwork.

More specifically, although air vacuuming cleaners used for air distribution systems may reach much of the area within the ducts of an air distribution system, the effectiveness thereof is limited by the common existence of abrupt turns in the ducts, changes in duct size to accommodate balanced air flow requirements, changes in duct profile such as from a rectangularly shaped configuration to a cylindrically shaped configuration, and changes from a rigid duct to a flexible duct, etc. Because of such obstructions and variations, dust and mold particles accumulate and remain within the duct system ready to be continually entrained and dispersed by the air flowing through the air distribution system when heating or air-conditioning units utilizing the air distribution system are operating.

In addition, such air vacuuming cleaners may be largely ineffective for removing contaminants and for sterilizing contaminating substances adhering to the walls of the air distribution system, such as toxic chemical or biological substances, for example.

Also, it is well-known that after a fire, such as in a home or in a place of business having a forced-air heating and ventilating system, it is difficult if not impossible to remove the soot and pungent smell of smoke that continues to permeate the building interior, much of which emanates from heat ducts of the air distribution system. The aforementioned air vacuuming cleaners are largely ineffective for removing such post-fire soot and sources of obtrusive odors.

Also, various offensive odors may be generated while an airliner is in flight wherein such odors are circulated through the passageways of an air distribution system of the airliner. Many times, the removal of such odors may be quite difficult and/or time-consuming. As a result, either the airliner may need to be grounded until the odors can be adequately removed, or the passengers of the continuing flights of that aircraft may have no choice but to endure those odors for the duration of their flight. Similar considerations apply to other public transportation vehicles, such as buses, cruise ships, and subways, for example.

Of much greater concern is contamination in an air distribution system arising from biological terrorism, such as anthrax contamination, or the like. Even if air vacuuming cleaners could remove all of such contamination, which is extremely doubtful, the ability to reliably filter absolutely all of such contamination from air exhausted by such air vacuuming cleaners is highly questionable. Because of the extreme danger posed by further release of such contaminants, the high risk of using air vacuuming cleaners under such circumstances must be avoided.

What is needed is an apparatus for cleaning an air distribution system that not only completely and thoroughly cleans but also sanitizes and decontaminates the air distribution system without posing a threat of re-contaminating the surrounding environment with contaminants and pollutants removed from the air distribution system.

PRINCIPAL OBJECTS AND ADVANTAGES OF THE INVENTION

The principal objects and advantages of the present invention include: providing a system and method for cleaning and decontaminating an air distribution system; providing such a system and method that includes a cleaning agent and an entraining agent; providing such a system and method that utilizes a foam-like substance for cleaning an air distribution system; providing such a system and method that is readily adaptable to a variety of different air distribution systems; and generally providing such a system and method that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

SUMMARY OF THE INVENTION

The improvements of the apparatus of the present invention for cleaning and decontaminating an air distribution system include source means separately containing a first fluid and a second fluid, pressurizing means structured to separately pressurize the first and second fluids of the source means, injection means including at least one injector connected to the air distribution system, a first distribution subsystem structured to convey the first fluid from the source means to the at least one injector, a second distribution subsystem structured to convey the second fluid from the source means to the at least one injector, control means structured to control the pressure and flow rate at which the first and second fluids are conveyed by the first and second distribution subsystems to the at least one injector, and cleanup means which includes a filtered wet-vacuuming system is structured to remove at least the first fluid from the air distribution system. Each at least one injector is structured to receive and covert the first and second fluids into a foam-like substance and to inject the foam-like substance into the air distribution system and each at least one injector includes foaming means. The present invention is applicable to air distribution systems of both build structures and non-building structures. A preferred first fluid of the present invention is hydrogen peroxide.

The present invention discloses a method for cleaning, sanitizing and decontaminating an air distribution system.

DETAILED DESCRIPTION OF THE INVENTION

Figure 1:
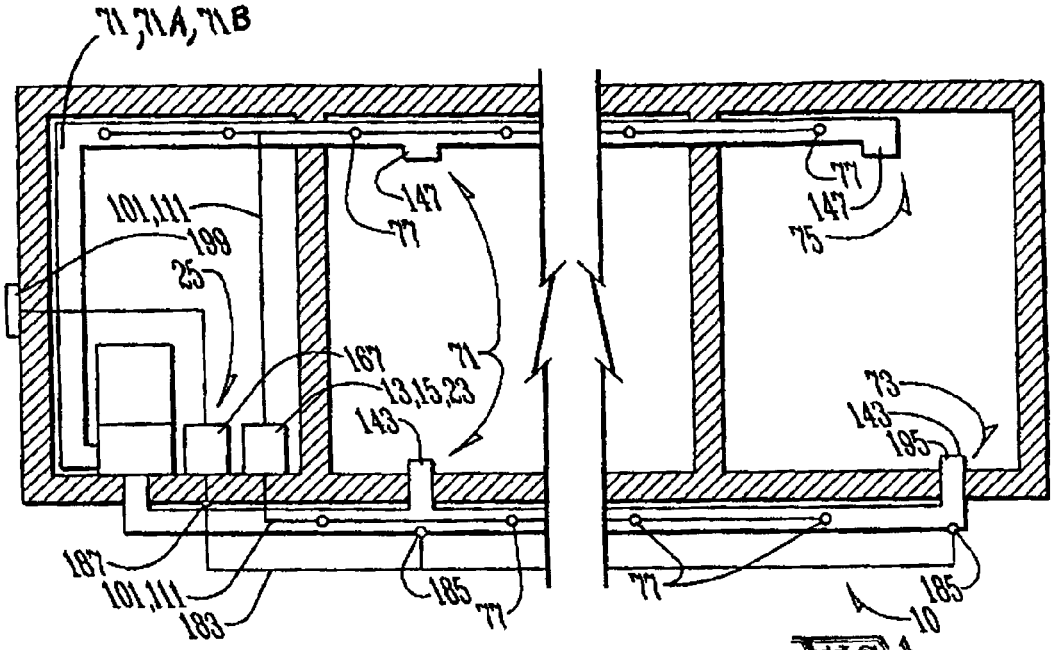
FIG. 1 is a schematic representation of an apparatus for cleaning and decontaminating an air distribution system, according to the present invention.

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

The present invention is easily adaptable for installation and use in various types of building structures such as commercial buildings, residential dwellings and housing, hospitals, and high rise apartments for example, and for installation and use in various types of non-building structures such as airplanes, cruise ships, trains, subways, and cars for example, or for any other structure or mode of transportation that has an air distribution system. The self-cleaning and sanitizing characteristics of the present invention are structured to clean and decontaminate air distribution systems by using a foam-like substance that absorbs and entraps dirt, mold, and other debris and pollutants that accumulate and reside in such air distribution systems. Application of the present invention is safe and cost effective, and prevents air borne particles such as mold spores, dust, allergens, pet dander, fungi and other contaminates and pollutants, that accumulate and reside in air distribution systems, from being re-circulated back into the ambient atmosphere that is accessible to breathing individuals occupying the structure utilizing the air distribution system, thus greatly improving air quality and safety within such structures.

By use of the cleaning and decontaminating system of the present invention, a foam-like substance containing a cleaning substance that engulfs and absorbs the undesirable particles and pollutants is injected into the air distribution system. The foam-like substance, which is injected into the air distribution system until the air distribution system is completely filled so the foam-like substance will contact all interior surfaces of the air distribution system, that may contact air flowing through the air distribution system, in order to destroy or remove any contaminants or pollutants that may be adhered to those interior surfaces. The foam-like substance with the particles and pollutants entrapped therein is then wet-vacuumed out of the air distribution system. If desired, a mist spray may then be injected into the air distribution system to further sanitize the air distribution system, whereupon the air distribution system may be wet-vacuumed again as an extra precaution, if needed, followed by drying with air circulated through the air distribution system by an air handler of the air distribution system.

The reference numeral 10 generally refers to an apparatus for cleaning and decontaminating an air distribution system in accordance with the present invention, as shown in FIGS. 1 through 12. The cleaning and decontaminating apparatus 10 of the present invention includes source means 13, pressurizing means 15, injection means 17, distribution system 19, barrier means 21, control means 23, and cleanup means 25.

Figure 2:
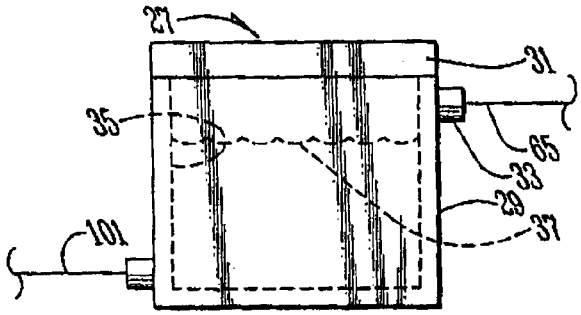
FIG. 2 is a schematic view of a first source of the apparatus for cleaning and decontaminating an air distribution system of the present invention.

As schematically shown in greater detail in FIG. 2, the source means 13 generally includes a first source 27 having a first body 29, a removable first lid 31, and a first port 33, wherein the first lid 31 is structured to form a fluid-tight seal with the first body 29 thereby defining a first reservoir 35 in the first source 27. In use, the first reservoir 35 generally contains a first fluid 37, sometimes referred to herein as a cleaning agent. It is to be understood that "cleaning agent" may include sanitizing agents, decontaminating agents, sterilants, detergents, and the like, including any and all suitable combinations thereof.

Figure 3:
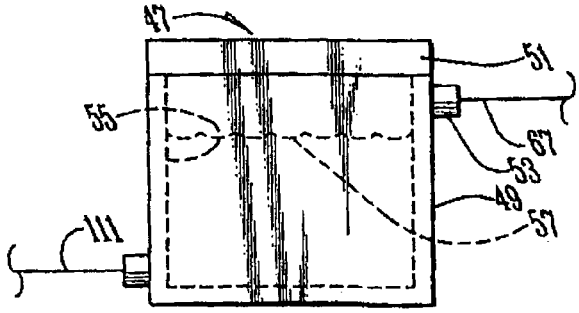
FIG. 3 is a schematic view of a second source of the apparatus for cleaning and decontaminating an air distribution system of the present invention.

As schematically shown in greater detail in FIG. 3, the source means 13 also generally includes a second source 47 having a second body 49, a removable second lid 51, and a second port 53, wherein the second lid 51 is structured to form a fluid-tight seal with the second body 49 thereby defining a second reservoir 55 in the second source 47. In use, the second reservoir 55 generally contains a second fluid 57, such as an entraining agent.

Figure 4:
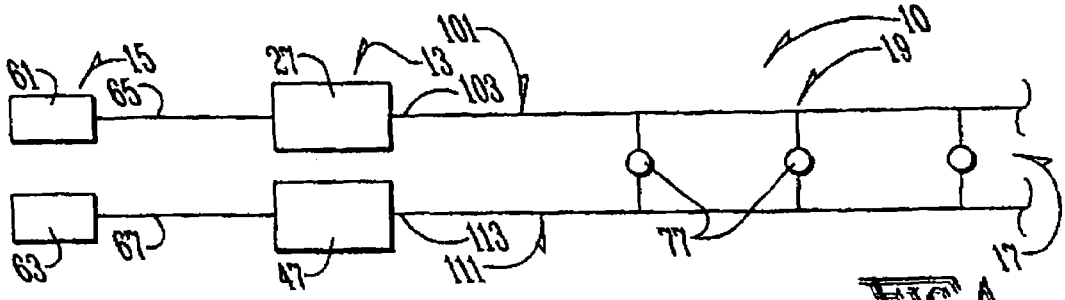
FIG. 4 is a schematic representation of pressurizing means, source means, distribution means, and injection means of the apparatus for cleaning and decontaminating an air distribution system of the present invention.
Figure 5:
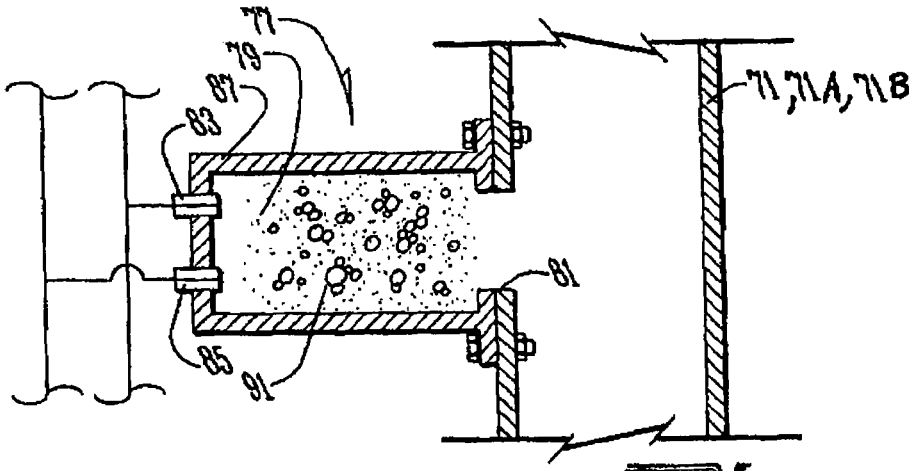
FIG. 5 is an enlarged schematic representation of an injector of the apparatus for cleaning and decontaminating an air distribution system of the present invention.

The pressurizing means 15 may include a first compressor 61 and a second compressor 63, as schematically shown in FIG. 4. A first, preferably flexible, conduit 65 connects the first compressor 61 in flow communication with first port 33 of the first source 27. The first compressor 61 is structured to operatively maintain the first fluid 37 in the first reservoir 35 at a selected first pressure within a range of desired pressures, such as a selected first pressure of approximately eight pounds per square inch.

Similarly, a second, preferably flexible, conduit 67 connects the second compressor 63 in flow communication with second port 53 of the second source 47. The second compressor 63 is structured to operatively maintain the second fluid 57 in the second reservoir 55 at a selected second pressure within a range of desired pressures, such as a selected second pressure of approximately sixteen pounds per square inch. Alternatively, the first and second compressors 61, 63 may be replaced by a single compressor with a pressure regulator arrangement as appropriate to separately provide desired pressurization to the first and second fluids 37, 57 in their respective first and second reservoirs 35, 55. Since such pressure regulator arrangements are known to those skilled in the pertinent art, an appropriate pressure regulator arrangement will not be described herein in detail.

The cleaning and decontaminating apparatus 10 of the present invention is applicable to an air distribution system 71, such as a heating/ventilating duct 71A, an air passageway in an airliner or cruise ship 71B, or the like. Although most air distribution systems 71 have both an air source branch 73 and an air return branch 75, the following disclosure primarily describes the present invention in regard to the air source branch 73 of air distribution systems 71. It is to be understood, however, that the present invention is equally applicable, perhaps with minor modifications, to the air return branches 75 of air distribution systems 71 for those structures and vehicles that have an air return branch 75. Further, the following disclosure primarily describes the present invention in regard to the air distribution system 71A of a building structure, it being understood that the present invention is equally applicable, again perhaps with minor modifications, to the air distribution system 71B of non-building structures.

The injection means 17 includes at least one injector 77 secured to the air distribution system 71, such as a heating/ventilating duct 71A, an air passageway in an airliner or cruise ship 71B, or the like. For most installations of the present invention, however, the injection means 17 includes a plurality of the injectors 77, as hereinafter described. As schematically shown in the enlarged cross-sectional view of FIG. 5, each injector 77 has a mixing chamber 79 with a distal end 81 that opens into the air distribution system 71. Each injector 77 also has a first orifice device 83 and a second orifice device 85, wherein each device 83, 85 opens into a proximal end 87 of the mixing chamber 79.

The mixing chamber 79 of each injector 77 may include a foaming means 91 comprising, for example, shredded material such as steel wool, beads such as glass beads, including combinations thereof or any other suitable foam-generating media that creates a turbulent environment for combining fluids entering the mixing chamber 79 through the first and second orifice devices 83, 85, wherein the foaming means causes those fluids to be thoroughly intermixed and converted to a substance having a foam-like consistency.

The distribution means 19 includes a first distribution subsystem 101 having a first input end 103 that connects the first reservoir 35 of the first source 27 in flow communication with the first orifice device 83 of each injector 77. The distribution means 19 also includes a second distribution subsystem 111 having a second input end 113 that connects the second reservoir 55 of the second source 47 in flow communication with the second orifice device 85 of each injector 77. The first orifice device 83 is structured and dimensioned to maintain the pressure of the first fluid 37 in the first distribution subsystem 101 at a first desired pressure as the first fluid 37 enters each mixing chamber 79. Similarly, the second orifice device 55 is structured and dimensioned to maintain the pressure of the second fluid 57 in the second distribution subsystem 111 at a desired second pressure as the second fluid 57 enters each mixing chamber 79.

For some installations of the present invention utilizing a plurality of the injectors 77, the spacing between adjacent ones of the injectors 77 along the air distribution system 71 may be approximately ten feet. However, the spacing between adjacent injectors 77 is determined by the relative internal volume of the air distribution system 71 being served by each of the plurality of injectors 77. Preferably, a majority of the injectors 77 are spaced such that an approximately equal internal volume of the air distribution system 71 is allotted to each of those injectors 77. For portions of the internal volume of the air distribution system 71 that cannot be approximately equally allotted, the internal volume of the air distribution system 71 allotted to each of the remaining injectors 77 of the plurality of injectors 77 is preferably smaller than that allotted to each of the equal-internal volume-spaced majority of the injectors 77 to ensure that all allotted internal volumes of the air distribution system 71 are completely filled with the foam-like substance as herein described when the internal volumes allotted to the equal-internal volume-spaced majority of the plurality of injectors 77 are filled.

It is to be understood that for structures with an air distribution system 71 having both an air source branch 73 and an air return branch 75, the present invention may include one installation for the air source branch 73 of the air distribution system 71 and another, separate installation for the air return branch 75 of the air distribution system 71. Alternately, the present invention may include a single installation designed to clean both branches 73, 75 simultaneously. In that event, a different spacing between the equal-internal volume-spacing of the majority of the injectors 77 along the air source branch 73 of the air distribution system 71 may be different from the equal-internal volume-spacing of the majority of the injectors 77 along the air return branch 75 of the air distribution system 71 to ensure that all allotted internal volumes of the air distribution system 71 are completely filled with the foam-like substance as herein described when the internal volumes allotted to the equal-internal volume-spaced majority of the plurality of injectors 77 along both the air source and air return branches 73, 75 are filled.

Generally, the plurality of injectors 77 as well as the first and second distribution subsystems 101, 111 connected to the first and second orifice devices 83, 85 are permanently installed along the air distribution system 71 with the first and second input ends 103, 113 of the first and second distribution subsystems 101, 111 located at a convenient location, such as in a furnace room near an air handler unit 121 of the structure having the air distribution system 71.

Figure 6:
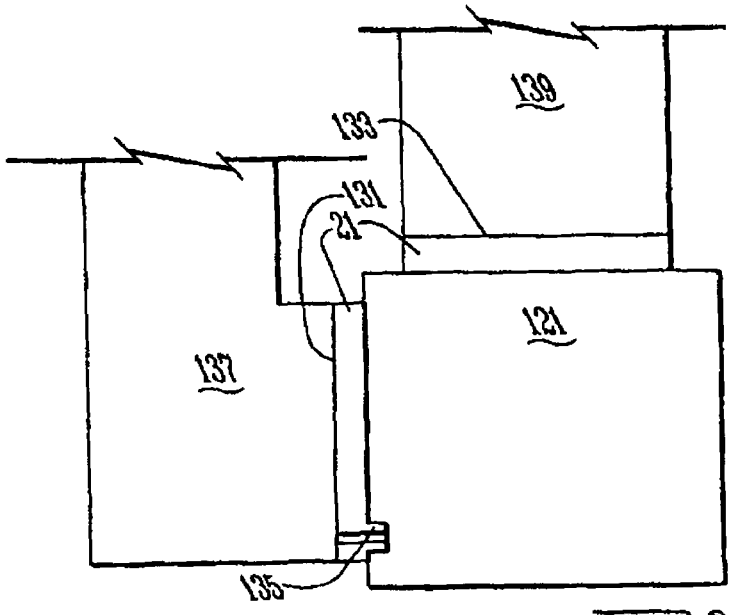
FIG. 6 is a schematic representation of first and second blocking elements of blocking means of the apparatus for cleaning and decontaminating an air distribution system of the present invention.

As schematically shown in FIG. 6, the barrier means 21 of the present invention includes a first blocking element 131 and a second blocking element 133 constructed of rigid material, such as styrofoam or other suitable material. The first blocking element 131, which has a cleanup port 135, is dimensioned to slidably fit within and block a cold air return duct 137 that connects to the input of the air handler unit 121 of the air distribution system 71. The second blocking element 133 is dimensioned to slidably fit within and block a source duct 139 that connects to the output of the air handler unit 121 of the air distribution system 71.

Figure 7:
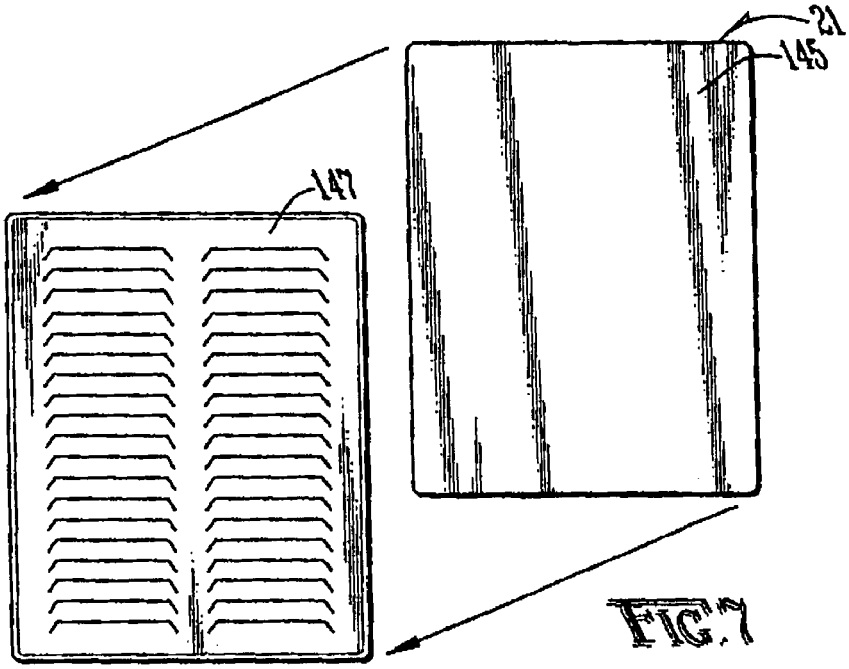
FIG. 7 is a schematic representation of an air return cap of the blocking means of the apparatus for cleaning and decontaminating an air distribution system of the present invention.
Figure 8:
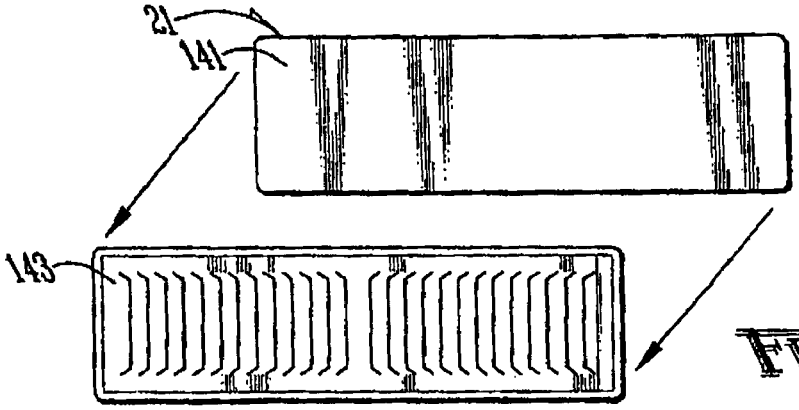
FIG. 8 is a schematic representation of a register cap of the blocking means of the apparatus for cleaning and decontaminating an air distribution system of the present invention.

As schematically shown in FIGS. 7 and 8, the barrier means 21 also includes a plurality of register caps 141 dimensioned and structured to be secured to and block each of the registers 143 of the air source branch 73 of the air distribution system 71, and a plurality of air return caps 145 dimensioned and structured to be secured to and block each of the cold air return vents 147 of the air return branch 75 of the air distribution system 71.

Figure 9:
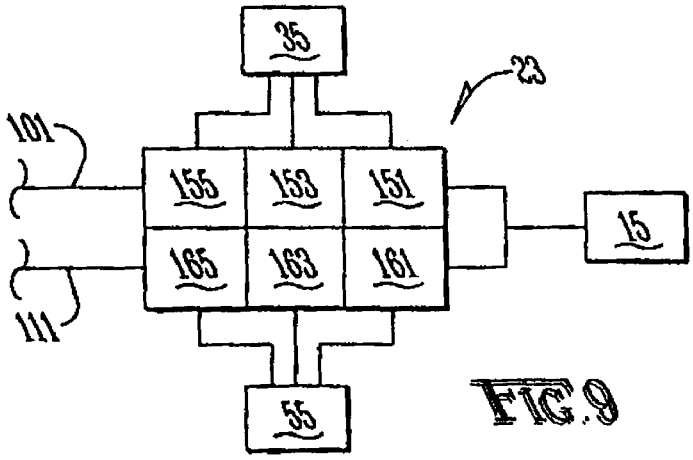
FIG. 9 is a schematic representation of control means of the apparatus for cleaning and decontaminating an air distribution system of the present invention.

The control means 23 includes a first pressure control mechanism 151 that can be used to operatively adjust the pressure being provided to the first reservoir 35 by the pressurizing means 15, a first pressure gauge 153 appropriately connected to monitor the first pressure in the first reservoir 35, and a first control valve 155 that can be used to operatively control the flow of the first fluid 37 from the first reservoir 35 into the first distribution subsystem 101, as schematically shown in FIG. 9.

The control means 23 also includes a second pressure control mechanism 161 that can be used to operatively adjust the pressure being provided to the second reservoir 55 by the pressurizing means 15, a second pressure gauge 163 appropriately connected to monitor the second pressure in the second reservoir 55, and a second control valve 165 that can be used to operatively control the flow of the second fluid 57 from the second reservoir 55 into the second distribution subsystem 111.

Figure 10:
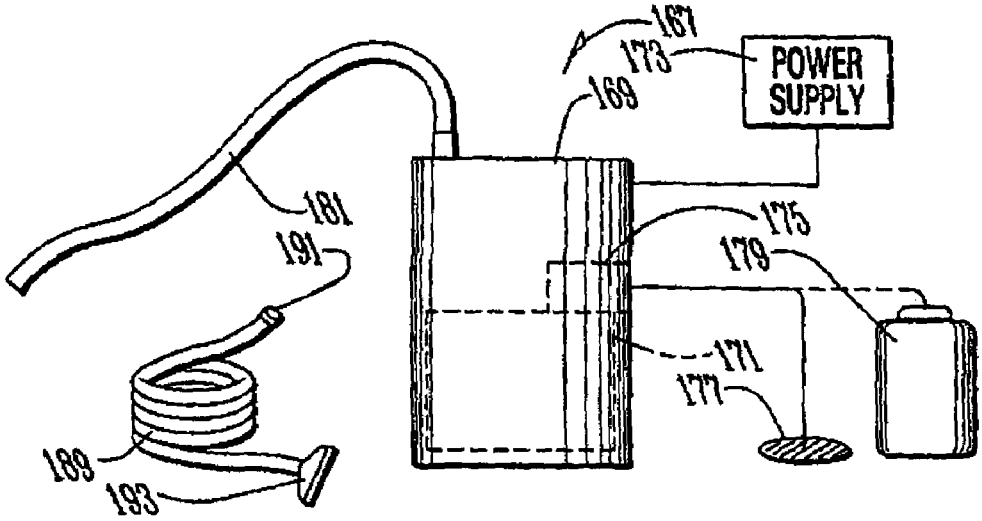
FIG. 10 is a schematic representation of cleanup means of the apparatus for cleaning and decontaminating an air distribution system of the present invention.

As schematically shown in FIG. 10, the cleanup means 25 generally includes a filtered wet-vacuuming system 167, which may include a wet-vacuuming cleaner 169 having a tank 171, wherein the wet-vacuuming cleaner 169 is powered by a power supply 173, such as an electrical circuit or receptacle of the structure having the air distribution system 71. The wet-vacuuming cleaner 169 may have an automatic tank-emptying system 175, wherein the wet-vacuuming cleaner 169 periodically shuts off for a few minutes while it flushes the contents of the tank 171 through a drain line 177 connected to a plumbing drain or, alternatively as indicated by a dashed line in FIG. 10, to a contamination container 179 for further disposal. The cleanup means 25 also includes a drain hose 181 structured to releasably connect an input of the wet-vacuuming cleaner 169 to the cleanup port 135 of the first blocking element 131.

Figure 11:
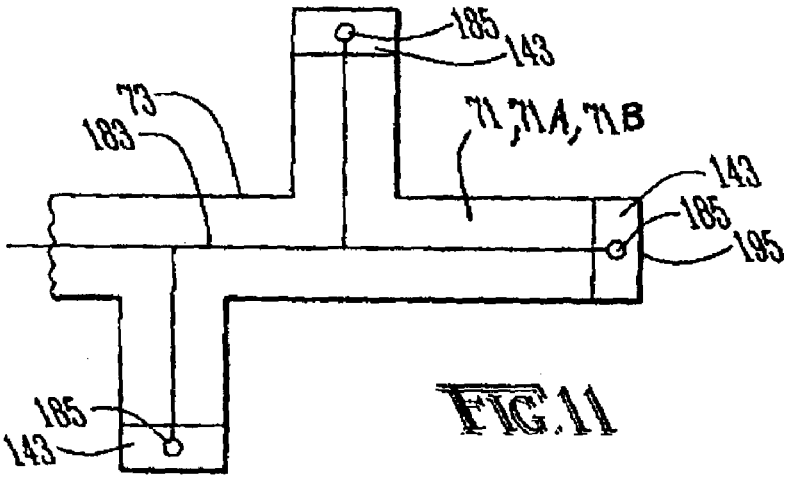
FIG. 11 is a schematic representation of a vacuum tubing network of the apparatus for cleaning and decontaminating an air distribution system of the present invention.
Figure 12:
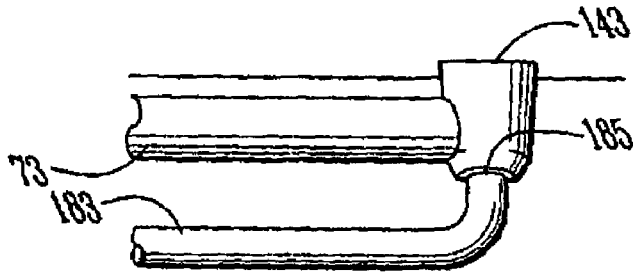
FIG. 12 is a schematic representation of an inlet of the vacuum tubing network of the apparatus for cleaning and decontaminating an air distribution system of the present invention.

For some applications of the present invention, the wet-vacuuming cleaner 169 may include a permanently installed vacuum tubing network 183 having an inlet 185 at each of the registers 143 of the air source branch 73 of the air distribution system 71, as schematically shown in FIG. 11. If desired, the present invention may include a depression in the duct around each of the inlets 185 to assist in funneling the foam-like substance into the network 183. The network 183 includes an outlet end 187 releasably connected to the input of the wet-vacuuming cleaner 169. For such installations, the source means 13, the pressurizing means 15, the control means 23, and the wet-vacuuming cleaner 169 may be portable so they can be easily moved from one such installation to another such installation to thereby provide periodic cleaning and decontaminating services at different installations with the same portable equipment.

For installations not having a permanently installed network 183, the portable version of the wet-vacuuming cleaner 169 includes a main hose 189 having a connecting end 191 structured to form a fluid-tight seal with the input of the wet-vacuuming cleaner 169, and a suctioning end 193 structured to suction the foam-like substance from the air source branch 73 of the air distribution system 71, wherein the length of the main hose 189 is sufficient to reach all of the interior volume of the air source branch 73 of the air distribution system 71 from the locations of the registers 143 of the air source branch 73.

In an application of the present invention, initial preparation includes removing the fan of the air handler unit 121 and cleaning and decontaminating the fan and the inside surfaces of the air handler unit 121. The fan is then re-installed in the air handler unit 121. To prevent foam-like substance from entering the air handler unit 121 during the cleaning process of the present invention, the first blocking element 131 is installed in the input or cold air return plenum 137 of the air handler unit 121, and the second blocking element 133 is installed in the output or source plenum 139 of the air handler unit 121. The drain hose 181 is used to connect the cleanup port 135 on the first blocking element 131 in flow communication with the input of the wet-vacuuming cleaner 169. All filters in the air distribution system 71 are removed, and caps 145, 147 are installed on all registers 143 and cold air returns 147.

Next, the first control valve 155 is closed, the first fluid 37, such as 11% hydrogen peroxide, is placed in first reservoir 35, and the first lid 31 is secured to the first body 29 to form a fluid-tight seal therebetween. The first conduit 65 is used to connect the first port 33 in flow communication with the pressurizing means 15.

Similarly, the second control valve 165 is closed, the second fluid 57, which in some applications may simply be atmospheric air, in the second reservoir 55, and the second lid 51 is secured to the second body 49 to form a fluid-tight seal therebetween. The second conduit 67 is used to connect the second port 53 in flow communication with the pressurizing means 15.

Then, the pressurizing means 15 is activated to pressurize the first fluid 37 in the first reservoir 35 to a desired first pressure as indicated by the first pressure gauge 153 of the control means 23, and to pressurize the second fluid 57 in the second reservoir 55 to a desired second pressure as indicated by the second pressure gauge 163 of the control means 23. The pressure in the first source 27 may be adjusted as needed by manipulating the first pressure control mechanism 151 of the control means 23, and the pressure in the second source 47 may be adjusted as needed by manipulating the second pressure control mechanism 161 of the control means 23.

To begin the cleaning process, the first control valve 155 and the second control valve 165 are opened causing the first and second fluids 37, 57 to be separately distributed by the first and second distribution subsystems 101, 111 to each of the injectors 77. As the first and second fluids 37, 57 flow through the mixing chambers 79 of the injectors 77, turbulence generated therein by the foaming means 91 causes the first and second fluids 37, 57 to be intermixed and converted to a foam-like substance, which expands into the air distribution system 71 through the distal ends 81 of the injectors 77. Cap 141 of the register 143 farthest from the air handler unit 121 in terms distance along the air source branch 73 of the air distribution system 71, sometimes referred to herein as the end register 195, is removed until the foam-like substance, injected into the air distribution system 71 by the injectors 77, becomes visible in the ductwork at the end register 195. The cap 141 is then replaced on the end register 195 and the foam injection process is continued for a predetermined period of time, such as ten more minutes for example, sometimes referred to herein as the cleaning time period to ensure that the entire interior volume of the air distribution system 71 is completely filled with the foam-like substance and to allow sufficient time for the foam-like substance to absorb and entrap the debris residing in the air distribution system 71 including sufficient time for the foam-like substance to decontaminate mold and other pollutants adhering to the walls of the air distribution system 71. The actual length of the cleaning time period depends on cross-sectional area, volume, and lengths of the ducts of the air distribution system 71 being cleaned.

After the cleaning time period has expired, the first and second control valves 155, 165 are closed. If the second fluid 57 is atmospheric air or another inert gaseous fluid, the first and second distribution subsystems 101, 111 may be disconnected from the first and second sources 27, 47 and the first distribution subsystem 101 reconnected to the second reservoir 55. The second control valve 165 is then opened for an additional period of time, five minutes for example, sometimes referred to herein as the expelling time period, in order to expel any first fluid 37 remaining in the first distribution subsystem 101 and any first fluid 37 and foam-like substance remaining in the mixing chambers 79 of the injectors 77.

If the second fluid 57 is not atmospheric air or another inert gaseous fluid, the present invention may include a bypass valving arrangement (not shown) interposed in the first and second distribution subsystems 101, 111 adjacently to the first and second sources 27, 47 wherein the pressurizing means 15 can be used to expel any remaining first fluid 37, second fluid 57, and foam-like substance from the first and second distribution subsystems 101, 111 and from the mixing chambers 79 of the injectors 77.

Next, the cleanup means 25 is used to remove the soiled foam-like substance from the air distribution system 71. The second blocking element 133 is removed from the source air duct 139. If the installation includes the vacuum tubing network 183, the outlet end 187 of the vacuum tubing network 183 is connected to the input of the wet-vacuuming cleaner 169. The wet-vacuuming cleaner 169 is activated to begin removing the soiled foam-like substance from the air source branch 73 of the air distribution system 71 through the inlets 185. The air handler unit 121 may be activated to move air through the air source branch 73 of the air distribution system 71 to assist with moving the soiled foam-like substance along the air source branch 73 to the inlets 185.

While the wet-vacuuming cleaner 169 is operating, it may be desirable to vent the exhaust of the wet-vacuuming cleaner 169 through a vent 199 to the exterior of the structure having the air distribution system 71 being cleaned. If, however, the substances being removed from the air distribution system 71 are highly noxious, it may be desirable to filter the exhaust in a manner that reliably removes all noxious material from the exhaust in order to prevent any of the noxious material from being re-circulated into the atmosphere. Under such circumstances, however, it should be obvious that the quantity of residual noxious substances contained in the exhaust of the wet-vacuuming process of the present invention would be several orders of magnitude lower than the quantity of the noxious substances that would be contained in the exhaust of an air dry-vacuuming process. The wet-vacuuming cleaner 169 is allowed to continue operating for a period of time until all of the soiled foam-like substance has been removed from the air source branch 73 of the air distribution system 71, generally approximately ten minutes but, again, depending on the size and extent of the air source branch 73 of the air distribution system 71.

If the installation does not include the vacuum tubing network 183, a portable version of the wet-vacuuming cleaner 169 may be carried to each of the registers 143 of the air source branch 73 of the air distribution system 71. At each register 143 of the air source branch 73 of the air distribution system 71, the cap 141 is removed, the connecting end 191 of the main hose 189 is connected to the input of the portable wet-vacuuming cleaner 169, the suctioning end 193 of the main hose 189 is extended into the air distribution system 71, and the wet-vacuuming cleaner 169 is activated until all of the soiled foam-like substance that can be reached from the location of that register 143 has been suctioned into the wet-vacuuming cleaner 169. Cleanup of the air source branch 73 is continued at the location of each register 143 until all soiled foam-like substance has been removed from the air source branch 73 of the air distribution system 71.

Next, with the first blocking element 131 still in place in the cold air plenum 137 of the air handler unit 121, the drain hose 181 is used to connect the cleanup port 135 in flow communication with the input of the wet-vacuuming cleaner 169. The caps 145 are removed from the cold air returns 147 of the cold air branch 75 of the air distribution system 71. The wet-vacuuming cleaner 169 is then activated to remove the soiled foam-like substance from the air return branch 75 of the air distribution system 71. Again, the air handler unit 121 may be activated to move air through the air source branch 73 and back through the air return branch 75 of the air distribution system 71 to assist with moving the soiled foam-like substance along the air return branch 75 to the cleanup port 135 of the first blocking element 131. Activation of the wet-vacuuming cleaner 169 is continued until all of the soiled foam-like substance has been removed from the air return branch 75 of the air distribution system 71.

Finally, the first blocking element 131 is removed from the cold air plenum 137 of the air handler unit 121. The air handler unit 121 is then activated and allowed to run for a period of time, usually approximately ten minutes but, again, depending on the size and extent of the air distribution system, in order to dry any remaining moist interior surfaces of the air distribution system 71. All filters are then re-installed in the air distribution system 71.

It is to be understood that the present invention may be installed on existing structures, such as during remodeling, as well as on new construction.

Applications of the present invention to air distribution systems of airplanes, cruise ships, automotive vehicles, etc., is similar to that hereinbefore described, with minor variations as needed to adapt to any particular structure or vehicle.

It is to be understood that while certain forms of the present invention have been illustrated and described herein, it is not to be limited to the specific forms or arrangement of parts described and shown.

What is claimed and desired to be covered by Letters Patent is as follows:

1. Apparatus for cleaning and decontaminating an air distribution system having ductwork, comprising (a) source means separately containing a first fluid and a second fluid;

(b) pressurizing means structured to separately pressurize the first and second fluids of the source means;

(c) injection means including a plurality of injectors spaced along and permanently affixed to the air distribution system, the spacing between adjacent injectors of the plurality of injectors being determined by the relative internal volume of the air distribution system being served by each respective injector of the plurality of injectors;

(d) a first distribution subsystem structured to convey the first fluid from the source means to the plurality of injectors;

(e) a second distribution subsystem structured to convey the second fluid from the source means to the plurality of injectors;

(f) control means structured to control the pressure and flow rate at which the first and second fluids are conveyed by the first and second distribution subsystems to the plurality of injectors; and (g) a cleanup means structured to remove at least the first fluid from the air distribution system; and (h) wherein each of the plurality of injectors is structured to receive and covert the first and second fluids into a foam-like substance and to inject the foam-like substance into the air distribution system until ductwork thereof is completely filled and wherein the cleanup means is structured to subsequently remove at least the first fluid without exposure thereof to the atmosphere.

2. The apparatus as described in claim 1, wherein the pressure at which the first distribution subsystem delivers the first fluid to the plurality of injectors is approximately 8 psi.

3. The apparatus as described in claim 1, wherein the pressure at which the second distribution subsystem delivers the second fluid to the plurality of injectors is approximately 15 psi.

4. The apparatus as described in claim 1, wherein each of the plurality of injectors includes foaming means.

5. The apparatus as described in claim 4, wherein the foaming means includes a shredded media.

6. The apparatus as described in claim 5, wherein the shredded media includes steel wool.

7. The apparatus as described in claim 4, wherein the foaming means includes a beaded media.

8. The apparatus as described in claim 7, wherein the beaded media includes glass beads.

9. The apparatus as described in claim 1, wherein the air distribution system includes a heating/ventilating duct of a building structure.

10. The apparatus as described in claim 1, wherein the air distribution system includes an air passageway of an airliner or cruise ship.

11. The apparatus as described in claim 1, wherein the first fluid includes hydrogen peroxide.

12. The apparatus as described in claim 1, wherein the first fluid includes 11% hydrogen peroxide.

13. The apparatus as described in claim 1, wherein the first fluid includes a decontaminating agent.

14. The apparatus as described in claim 1, wherein the second fluid includes atmospheric air.

15. The apparatus as described in claim 1, wherein the first distribution subsystem includes tubing having a diameter of approximately one-eighth inch.

16. The apparatus as described in claim 1, wherein the second distribution subsystem includes tubing having a diameter of approximately one-eighth inch.

17. The apparatus as described in claim 1, wherein the cleanup means includes a wet-vacuuming cleaner.

18. The apparatus as described in claim 17, wherein the wet-vacuuming cleaner is portable.

19. The apparatus as described in claim 17, wherein the wet-vacuuming cleaner includes an automatic tank-emptying system.

20. The apparatus as described in claim 1, further comprising barrier means structured to operatively block air flow at an input and an output at an air handler of the air distribution system.

21. The apparatus as described in claim 1, further comprising barrier means including at least one register cap structured to operatively block air flow through a register of the air distribution system.

22. The apparatus as described in claim 1, further comprising barrier means including at least one air return cap structured to operatively block air flow through an air return of the air distribution system.

* * * * *